US005893631A

United States Patent [19]

Padden

[11] Patent Number: 5,893,631

[45] Date of Patent: Apr. 13, 1999

[54] COMPACT FLASHLIGHT

[76] Inventor: Stephen J. Padden, 1303 Cypress Point La., Apt. 204, Ventura, Calif. 93003

[21] Appl. No.: 08/963,167

[22] Filed: Nov. 3, 1997

[51] Int. Cl.[6] ..... F21L 7/00

[52] U.S. Cl. ..... 362/201; 362/119

[58] Field of Search ..... 362/200, 201, 362/203, 208, 119; 200/60

[56] References Cited

U.S. PATENT DOCUMENTS

| | | | |
|---|---|---|---|
| 2,714,152 | 7/1955 | Ackerman et al. | 240/10.65 |
| 3,345,488 | 10/1967 | Siegal | 200/153 |
| 3,717,759 | 2/1973 | Rousseau | 240/10.66 |
| 4,057,520 | 11/1977 | Schwartz | 200/16 D |
| 4,409,643 | 10/1983 | Frank et al. | 362/157 |
| 4,433,365 | 2/1984 | Rousseau | 362/189 |
| 4,442,478 | 4/1984 | Stansbury | 362/191 |
| 4,517,627 | 5/1985 | Bradford | 362/156 |
| 5,158,356 | 10/1992 | Guthrie | 362/188 |
| 5,328,026 | 7/1994 | Newman | 206/234 |
| 5,386,351 | 1/1995 | Tabor | 362/201 |
| 5,457,613 | 10/1995 | Vandenbelt et al. | 362/200 |
| 5,515,249 | 5/1996 | Shiao | 362/119 |

*Primary Examiner*—Stephen Husar
*Attorney, Agent, or Firm*—Kenneth J. Hovet

[57] ABSTRACT

A compact flashlight is provided having a base with an interior recess for permitting reciprocable movement of a disk battery. The base includes a bulb having a first lead that extends along the bottom of the interior recess. A second diverging lead extends from the bulb to an area along an upper side of the recess. The battery overlies the first lead so that electrical contact is made with the bottom portion of the battery. A carrier overlies the battery and includes a boss portion extending into an opening of a cover that encloses the base. Forward thumb pressure on the boss portion moves the battery from a bulb-off to a bulb-on position when the battery comes into electrical contact with the second diverging lead. This results in illumination of the bulb. The carrier is provided with resilient members extending outwardly from the back end of the carrier. The resilient members engage a corresponding detent in the housing and maintain the battery in an off position. Release of thumb pressure allows the resilient members to draw the carrier/battery back into an off position. The flashlight may exist as a self-contained unit or it may be incorporated into a variety of outer housing structures. It has particular applicability for use in thin housings that have a card-like shape.

26 Claims, 4 Drawing Sheets

COMPACT FLASHLIGHT

BACKGROUND OF THE INVENTION

1. Field of the Invention

The present invention pertains to flashlights and, more particularly, to small compact self-contained flashlights.

2. Description of Related Art

Miniaturizing flashlights makes them more adaptable to variety of applications and more useful as a personal item. However, endeavors to reduce the size of flashlights have not been noteworthy. For example, U.S. Pat. No. 5,158,356 discloses a miniature light assembly in which a user must grab the bulb and pull it outwardly from its housing. This movement draws an angular lead segment into contact with a battery to activate the bulb. Grasping a miniaturized bulb and pulling it outwardly generally requires two hands. Also, it is cumbersome for many people to grasp and pull a small glass bulb.

U.S. Pat. No. 3,717,759 discloses a pocket flashlight wherein a bulb is housed within a reciprocable casing. Instead of pulling out on the bulb, the casing is pushed in to make contact with a battery and activate the bulb. This construction requires multiple housing parts that create a flashlight that is bulky and unnecessarily heavy.

A different structure for activating a pocket flashlight is shown in U.S. Pat. No. 2,714,152. In this patent, the bulb is stationary and the battery is housed within a slidable housing cover member. Pushing forward on the cover member causes the battery electrical end contact to engage the bulb and complete the circuit for illuminating the bulb. This was a popular item but requires a standard AA or AAA sized battery. Thus, it is heavier and larger than necessary.

Another pocket light is shown in U.S. Pat. No. 4,517,627. This light utilizes a housing that is secured to the interior of a purse by a magnetic disk. The battery and bulb are stationary within the housing and activation of the bulb is accomplished through the use of a button which spreads apart the limbs of a U-shaped electric contact. When spread apart, the limbs complete the electrical circuit between the battery and bulb resulting in illumination. The above switch requires multiple mechanical and electrical parts and is not suitable for miniaturization.

To create a flashlight within a card-like housing, U.S. Pat. No. 5,457,613 utilizes layers of conductive foil material that form a circuit between a bulb and battery. The circuit is completed by pressing a spot on the housing sidewall that overlays an interior switch. A resilient foam pad over the switch maintains an electrical coupler in an off position out of contact with an adjacent conductive layer.

A problem with the above is that foil layers are fragile, easily corroded and are poor conductors of electricity. Moreover, depressing a foam pad so that electrical contact can be made is notoriously unreliable. Additionally, it is well known that foam materials harden and crumble over a relatively short period of time.

SUMMARY OF THE INVENTION

The present invention overcomes the above disadvantages by providing a compact flashlight that does not rely on foil laminates, foam pads, movable bulbs and cumbersome housing parts. The invention lends itself to use with thin card like housings wherein a complete flashlight unit can be conveniently fitted within the housing or be integrated into the housing parts. No circuitry is required other than two diverging leads extending directly from the bulb base.

Activation of the bulb is provided with a switch means which moves the battery into and out of direct engagement with both leads.

The switch means comprises a carrier which overlays and releasably engages the battery. The carrier also provides the actuation structure for manually switching the flashlight on and off. The switch means is maintained in a normal off position by use of a unique biasing means which extends from the carrier and engages a part of the compact housing interior. Only one hand is required to operate the flashlight.

DESCRIPTION OF THE PREFERRED EMBODIMENTS

Figure 1:
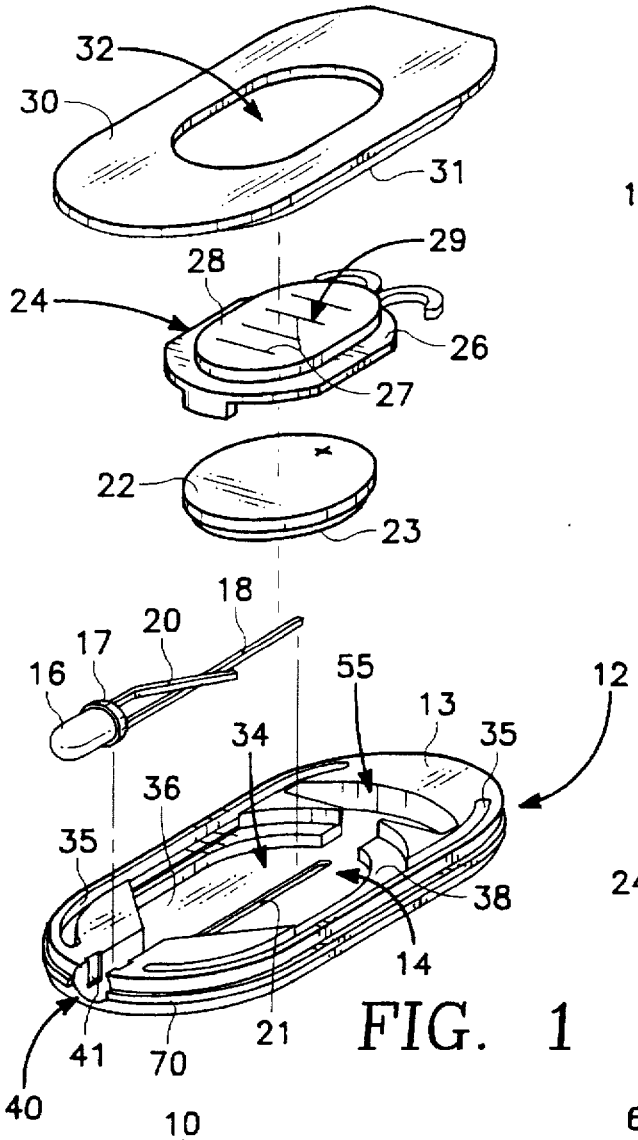
FIG. 1 is an exploded isometric view of a compact flashlight unit constructed in accordance with the invention.
Figure 2:
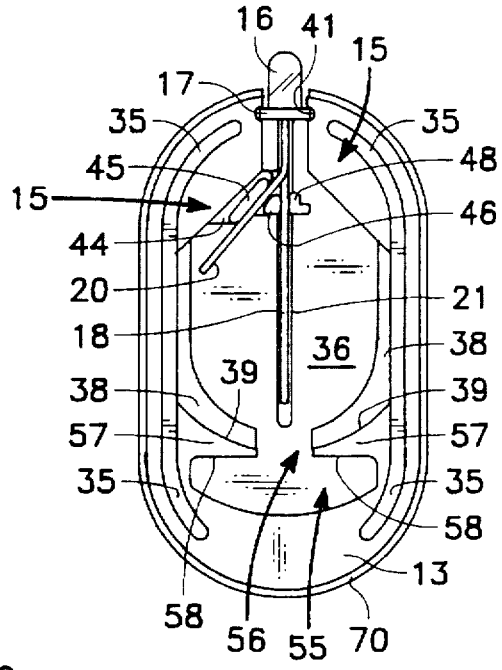
FIG. 2 is a top plan view of the bulb and base shown in FIG. 1 assembled together.
Figure 5:
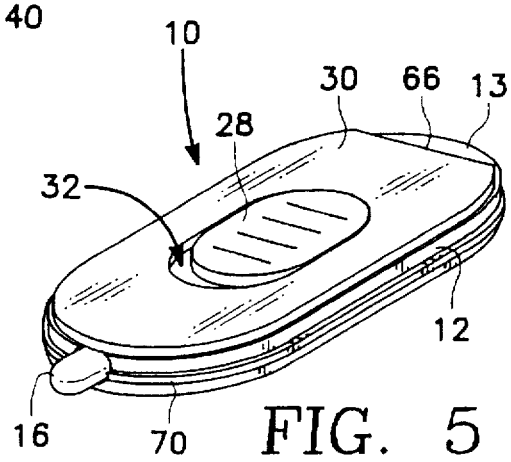
FIG. 5 is a front isometric view of the assembled form of the flashlight unit shown in FIG. 1.

With reference now to FIGS. 1 and 5, arrow 10 shows the overall flashlight of the invention as a self-contained unit. The flashlight assembly begins with a base 12 within which is formed an interior recess 14. The recess has a predetermined depth and outline sufficient to constrain a battery 22 and a battery carrier 24. Fitted within the front portion of the base is a bulb 16 from which extend a first lead 18 and a second diverging lead 20. Overlying the above parts is cover 30. A central opening 32 is provided in the cover to permit access to the carrier. Both the interior recess and central opening are sufficiently large to permit movement of the combined carrier and battery so that the battery can move into and out of contact with diverging lead 20.

More particularly, the interior recess 14 comprises an inner bottom surface 36 having an area defined by a peripheral shelf region 38. The opposing sides of the shelf region extend rearward from respective forward mirror image base parts 15,15 and incorporate midportions of opposing connector grooves 35. The shelf region terminates at passage 56 defined by spaced-apart inwardly curved mirror image walls 39,39 of opposing base partitions 57,57.

Extending axially outward from the front of interior recess 14 to the base outer periphery is a bulb aperture 40. The aperture extends along the longitudinal axis of the base and includes an upwardly extending collar notch 41 which is offset inwardly from the base periphery. The bulb is provided with a corresponding collar 17 which fits within the notch to affirmatively locate the bulb at the desired axial position within the aperture.

Extending coextensively from the aperture across bottom surface 36 is an elongated groove 21. The groove follows the bottom surface midline and is sized to engage the first lead 18.

To properly support the vertically offset diverging lead 20, a platform 44 is provided that rises above bottom surface 36 adjacent base part 15 and bulb aperture 40. The platform extends upwardly from the bottom surface to a level coextensive with the diverging lead. Also extending upwardly from the platform are a barrier part 45 and a peg 46. The peg is spaced apart from the barrier part a distance about equal to the width of diverging lead 20. The angled portion of the diverging lead may then fit between the peg and barrier part and extend to a distal end offset from base part 15.

To further secure both of the bulb leads in place, a post 48 is provided that is offset from peg 46 on the opposite side of groove 21. The first lead 18 passes between the peg and post within groove 21 so that the alignment and orientation of the entire bulb subassembly will be securely fixed against dislodgement.

With battery 22 located at a rearward position within the bottom recess 34, it will be out of contact with the second diverging lead. However, it will be in continuous contact with first lead 18. To accommodate the above configurations, the preferred battery has a disk shape in which its underside 23 has a negative polarity and the enlarged upper portion has a positive polarity. Such batteries are commonly used with watches, calculators, cameras and similar electronic products.

It is also preferred that bulb 16 comprise a light emitting diode (LED) having a predetermined color which will become illuminated with a relative small voltage. A battery suitable for use with the LED is a 3.0 volt lithium disk battery.

With the upper diverging lead angled to the side of the recess and elevated a predetermined distance sufficient to correspond with the upper positive portion of the disk battery, it will be a simple matter to simply move the battery forward toward the bulb to complete the circuit via contact with the second divergent lead. This corresponds to the bulb-on position.

It is expected that the diverging lead will have sufficient resilience to permit its repeated contact with the battery positive surface. If necessary, a support post may be located directly behind its distal end portion to prevent permanent distortion.

Figure 3:
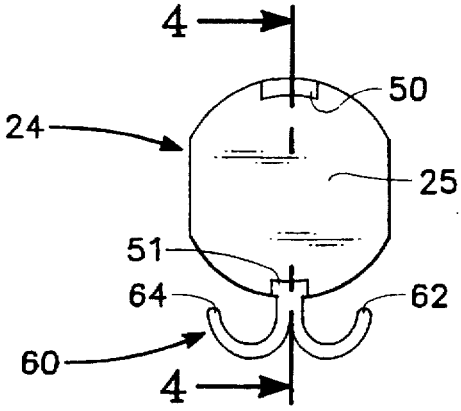
FIG. 3 is a bottom plan view of the carrier shown in FIG. 1.
Figure 4:
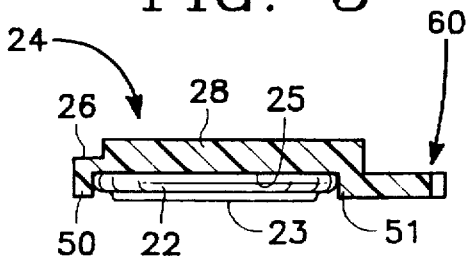
FIG. 4 is a cross-sectional view taken along lines 4—4 of FIG. 3.
Figure 6:
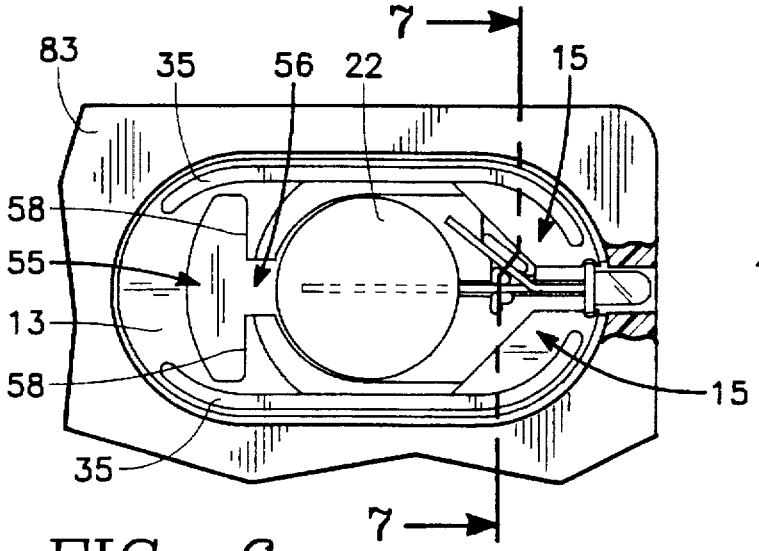
FIG. 6 is a top plan view of the flashlight unit shown in FIG. 5 incorporated within an outer housing, shown as a corner fragment, wherein the flashlight cover and battery carrier are removed to show the battery in a bulb-off position.
Figure 7:
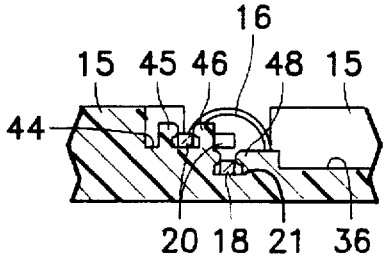
FIG. 7 is a fragmentary cross-sectional view taken along lines 7—7 of FIG. 6.

To facilitate battery movement as above described, a battery carrier 24 is provided. As shown in FIGS. 3 and 4, the carrier is disk-like in shape with an underside 25 against which the battery is held. The underside includes an engagement means for releasably securing the battery to the underside. As shown, the engagement means comprise deflectable arms 50,51 extending downwardly from opposing front and rear ends of the underside periphery. The deflectable arms coact against the battery periphery and cause the battery to move simultaneously with the carrier.

The main body of the carrier comprises a pedestal 26. The pedestal has a planar configuration that is greater than the planar configuration of bottom recess 34. It overlies peripheral shelf 38, but is constrained within the overall interior recess 14. Preferably, it has a configuration comprising rounded opposing ends corresponding to the curvature of curved walls 39. The pedestal has flat opposing sides that are spaced-apart a distance slightly less than the distance between opposing connector flanges 31 of cover 30. The connector flanges thereby provide stationary guide surfaces against which the pedestal sides will move during axial reciprocation of the carrier. The carrier length is less than the length of the interior recess to permit the sufficient axial movement to effect the bulb-on and bulb-off electrical connections.

Extending upwardly from the forward region of the pedestal upper surface is boss portion 28. The boss portion has a planar outline similar to central opening 32, except that it is shorter by a distance equal to the above-described axial reciprocation distance.

Preferably, the pedestal will have opposing straight sides which are spaced-apart a distance about equal to the distance between straight opposing sides of the central opening. In this way, the pedestal will be constrained from sideways movement while having room to move lengthwise within the central opening.

The top surface of the boss portion provides an abutment area 29. This area is accessible through the central opening or extends thereabove. In this way, a user may manually engage the area with one's finger and cause its axial movement within the central opening. The abutment area may include multiple transverse ribs 27 to enhance frictional engagement.

Connected to the carrier is a biasing means to provide a normal bulb-off position of the combined battery and carrier. The biasing means comprises a resilient member, shown generally by reference 60, extending axially outward from the back peripheral end of the carrier. It is configured to engage a predetermined portion of the base or cover.

As best shown in FIGS. 3, 4, 8 and 9, the resilient member extends axially outward from deflectable arm 51 and comprises at least one, and preferably two, flex elements that engage corresponding detent surfaces in the base. The detent surfaces comprise upstanding detent walls 58,58 of auxiliary recess 55.

The auxiliary recess is in communication with the interior recess 14 via the aforementioned passage 56. The passage allows resilient member 60 to pass from the bottom recess 34 into the auxiliary recess.

As indicated, the resilient member comprises two mirror image arcuate outwardly flared flex elements 62,64. The flex elements are an integral part of the carrier and detent arm. They have a resilience sufficient to withdraw the carrier/battery from a forward bulb-on position to a rearward bulb-off position when a user releases forward pressure against the boss portion 28.

Figure 8:
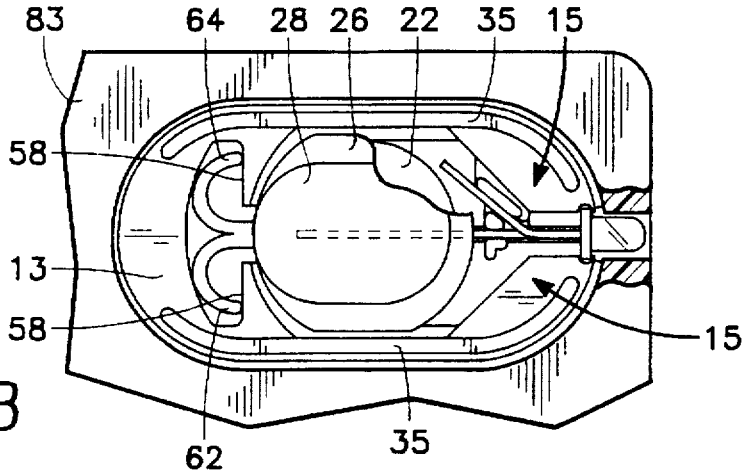
FIG. 8 is a top plan view similar to FIG. 6 with the carrier overlying the battery, except for a broken-away portion, wherein the combination is in a bulb-off position.
Figure 9:
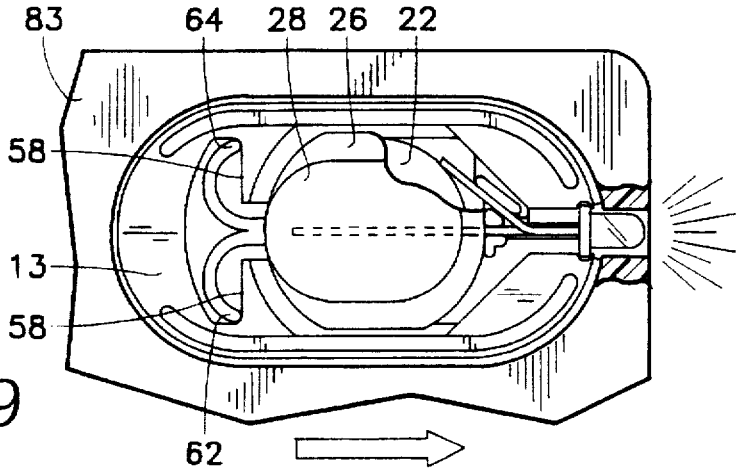
FIG. 9 is a top view similar to FIG. 8 wherein the combined carrier and battery are in a bulb-on position.
Figure 14:
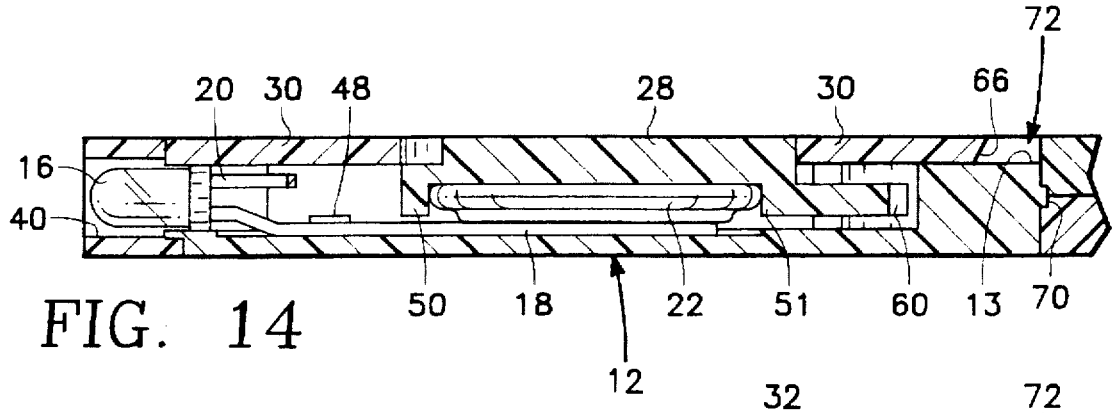
FIG. 14 is an enlarged cross-sectional view taken along lines 14—14 of FIG. 10.
Figure 15:
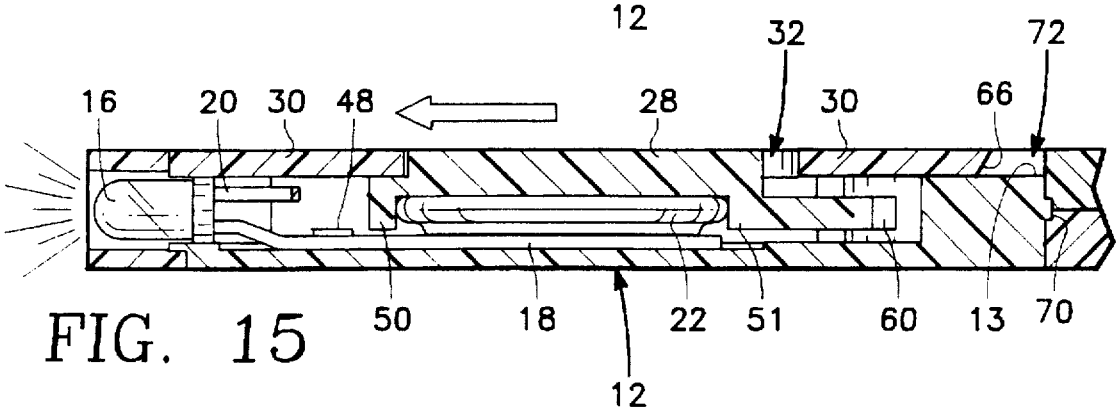
FIG. 15 is an enlarged cross-sectional view similar to FIG. 14 with the carrier/battery combination in a bulb-on position.

FIG. 8 shows the flex elements at rest with their free ends touching respective detent surfaces 58. This corresponds to the normal bulb-off position. FIG. 9 depicts axial movement of the carrier and battery toward the bulb whereby the battery comes in electrical contact with diverging lead 20. In this position, the arcuate flex elements are splayed outward with less curvature reflecting their flexure. When a user discontinues finger pressure against the abutment area 29, the elastic memory of the flex members will draw the carrier and battery back to the rearward bulb-off position. The above movements are also depicted in longitudinal cross-section in FIGS. 14 and 15.

To enclose the self-contained flashlight unit discussed above, a cover 30 is provided having the aforementioned central opening 32. The cover underside is provided with downward depending opposing cover flanges 31 which are mirror images of each other. They include straight midsections and slightly curved end portions for frictional engagement with corresponding connector grooves 35. The connector grooves extend along opposing sides of the base upper face 13.

Frictional engagement between the flanges and grooves should be sufficient to effect a tight connection—but not too secure to prevent one from removing it for replacing the battery. Particularly when the compact flashlight is used as a self-contained unit or when installed within an outer housing, access to the battery is necessary. This is accomplished by truncating the back end 66 of the cover. This allows one to engage the back end and lift the cover away from the base upper surfaces 13. The carrier can then be removed and the existing battery may be dislodged and replaced with a fresh battery.

To secure the flashlight unit within an outer housing, the base 12 is provided with an outer peripheral rib 70. The rib will frictionally engage the inner surfaces of a corresponding housing switch opening 72 as shown in FIGS. 10, 12, 14 and 15. The opening is formed through both upper plate 83 and lower plate 85 which are secured together to produce the overall outer housing.

Figure 10:
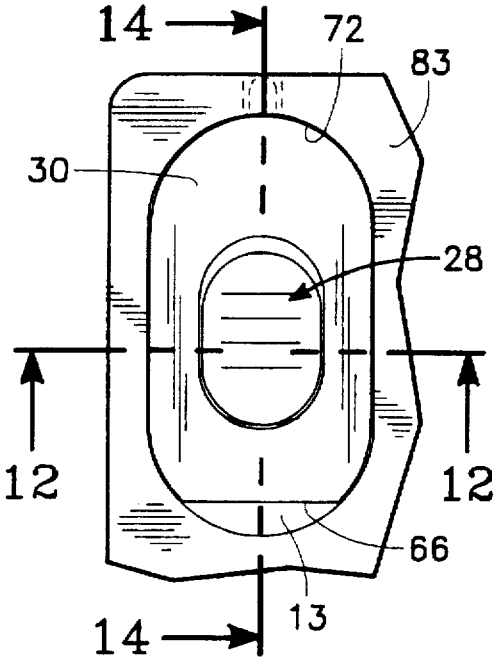
FIG. 10 is a top plan view similar to FIG. 8 with the cover shown in FIG. 1 overlying the carrier/battery combination and base interior recess.
Figure 16:
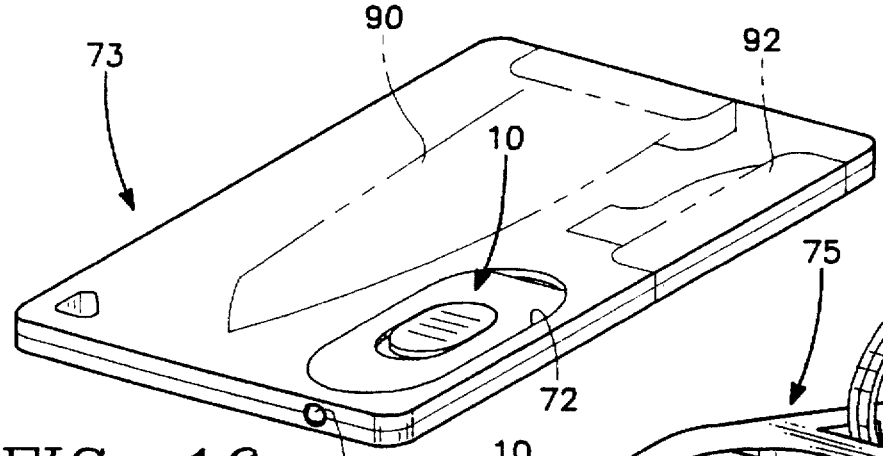
FIG. 16 is an isometric view of an outer multi-purpose implement housing comprising upper and lower flat plates shaped as a credit card incorporating the compact flashlight unit shown in FIG. 5.
Figure 17:
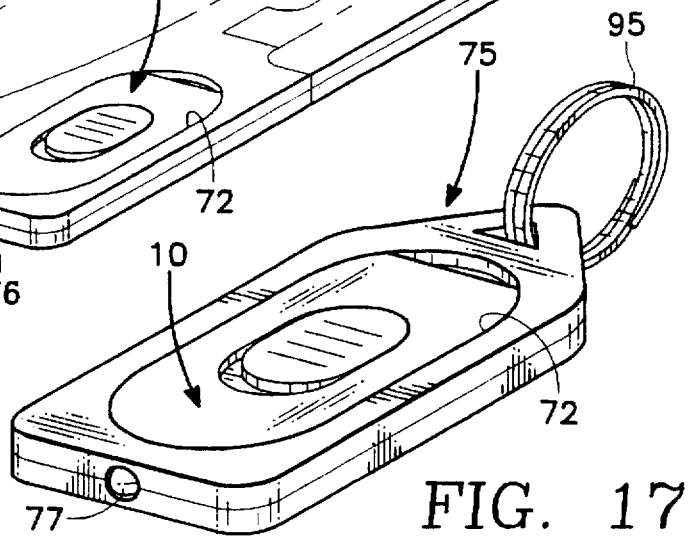
FIG. 17 is an isometric view showing the flashlight unit of FIG. 5 incorporated within upper and lower parts of a key tag housing.

A credit card shaped multi-purpose tool housing 73 is depicted in FIG. 16. Shown in phantom within the housing are typical implements such as a knife 90 and bottle/can opener 92. Other components could be incorporated within the housing such as an awl, tweezers, mirror, screwdriver, compass, clock, pen, calculator, scissors, golf accessories and brush. FIG. 17 illustrates a key ring 95 extending through an opening in a tag-shaped housing 75. In both of the above housings, respective switch openings 72 are provided as illustrated in FIG. 10. Such openings are proximate an edge of the outer housing to permit effective illumination through appropriate light apertures 76,77.

In the FIGS. 16 and 17 embodiments, the housings may or may not comprise an upper and lower flat plate as illustrated. The lower plate could be formed to include the interior recess as defined herein instead of having the entire flashlight unit inserted into an overall housing opening.

Figure 13:
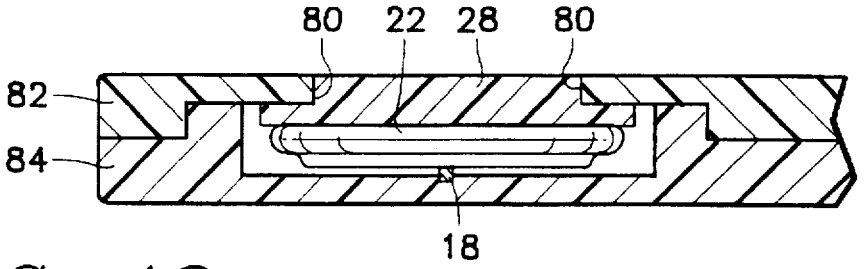
FIG. 13 is an enlarged cross-sectional view taken along lines 13—13 of FIG. 11.

FIGS. 9 and 13 depict an alternative embodiment wherein the base recesses are formed directly into the structure of a lower housing plate 84. In this embodiment, upper housing plate 82 would simply have a reduced switch opening 80 providing access to abutment area 29 of the carrier.

Figure 11:
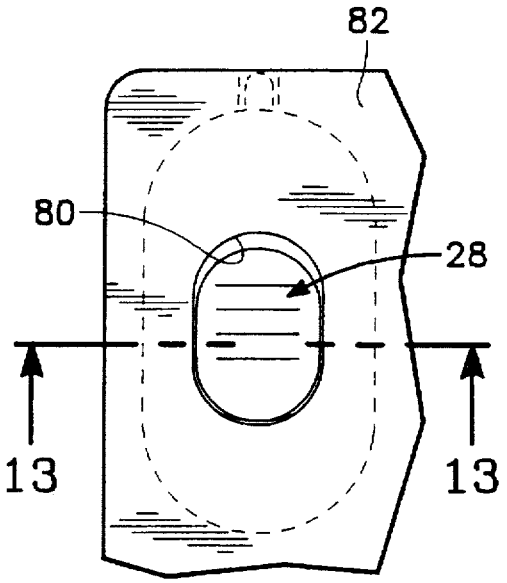
FIG. 11 is a view similar to FIG. 10 showing the basic components of the invention integrated within upper and lower plates of an outer housing.
Figure 12:
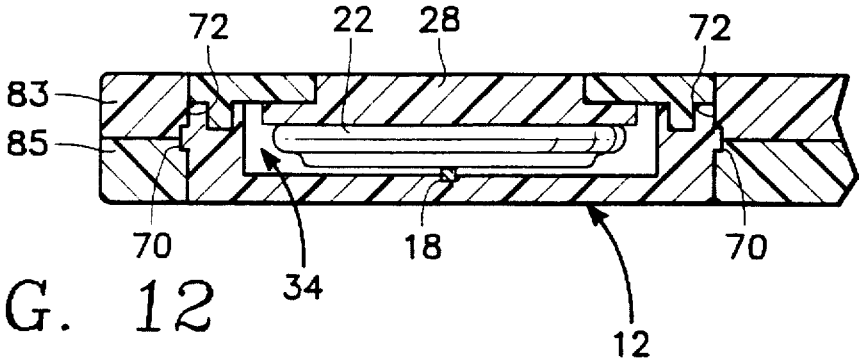
FIG. 12 is an enlarged cross-sectional view taken along lines 12—12 of FIG. 10.

Another variation of FIGS. 11 and 13 is where the bottom plate includes the interior recess as an integral part thereof. However, the top plate would have an enlarged switch opening sufficient to incorporate a removable cover in the same manner as if the light was an independent unit. This variation would have a top plan appearance similar to the embodiment depicted in FIG. 10.

While the invention has been described with respect to preferred embodiments, it will be clear to those skilled in the art that modifications and improvements may be made to the invention without departing from the spirit and scope of the invention. Therefore, the invention is not to be limited by the specific illustrative embodiments, but only by the scope of the appended claims.

I claim:

1. A compact flashlight comprising:

a base defined by an outer periphery with an interior recess;

a bulb proximate said outer periphery having first and second diverging leads extending into said recess;

a battery positioned in said interior recess in electrical contact with said first lead, said battery being movable within said recess to make electrical contact with said second lead causing illumination of said bulb; and, a cover overlying said base.

2. The flashlight of claim 1 including a carrier in engagement with said battery whereby movement of said carrier will result in a like movement of said battery.

3. The flashlight of claim 2 wherein said carrier has a manual actuation area and said cover includes a central opening providing access to said actuation area.

4. The flashlight of claim 1 including biasing means engaged with said base for maintaining said battery in an off position out of contact with said second lead.

5. The flashlight of claim 4 wherein said biasing means interconnects said carrier with said base.

6. The flashlight of claim 5 wherein said base includes an auxiliary recess and said biasing means comprises a resilient member engaged with said auxiliary recess.

7. The flashlight of claim 6 wherein said resilient member comprises at least one flex element extending outwardly from said carrier.

8. The flashlight of claim 6 wherein said auxiliary recess includes two opposing detent surfaces and said resilient member comprises two outwardly flared flex elements each of which are engageable with a respective one of said detent surfaces.

9. The flashlight of claim 3 wherein said central opening has a defined planar shape and said carrier includes a pedestal that is movable within said interior recess and has a planar shape that is larger than the planar shape of said central opening.

10. The flashlight of claim 9 wherein said pedestal has an underside from which extends battery engagement means for maintaining said battery within said underside.

11. The flashlight of claim 10 wherein said engagement means comprises a deflectable arm extending from at least one end portion of said underside.

12. The flashlight of claim 9 wherein said carrier includes a boss portion extending upwardly into said central opening from said pedestal having a top surface that provides said actuation area, said boss portion having a planar shape that is smaller than the planar shape of said central opening.

13. The flashlight of claim 12 wherein each of the planar shapes of said central opening and said boss portion include opposing straight sides each of which are about equal distance apart, respectively, and wherein said central opening has a length that is greater than the length of said boss portion.

14. A flashlight comprising:

a base plate having a peripheral edge and an upper surface with an interior recess;

a cover plate overlying said base plate having a central opening;

a bulb located adjacent said edge having diverging first and second leads extending into said interior recess;

a battery movable within said interior recess from a bulb-off position out of contact with one of said leads to a bulb-on position in contact with both of said leads; and, a switch means in said interior recess accessible through said central opening for moving said battery from said bulb-off position to said bulb-on position.

15. The flashlight of claim 14 wherein said switch means includes a carrier having an engagement means for releasable attachment with said battery.

16. The flashlight of claim 15 wherein said carrier includes a biasing means for moving said switch means from said bulb-on position to said bulb-off position.

17. The flashlight of claim 16 wherein either one or both of said base plate and cover plate include a detent surface and said biasing means comprises a resilient member engageable with said detent surface.

18. The flashlight of claim 16 wherein said carrier includes a boss portion extending into said central opening having a planar shape that is smaller than said central opening.

19. The flashlight of claim 18 wherein the planar shape of both of said central opening and said boss portion include respective opposing straight sides which are about equidistant apart and the length of said central opening is greater than the length of said boss portion.

20. The flashlight of claim 14 wherein said bulb extends outwardly a predetermined distance from said peripheral edge; and, an outer housing having an outer edge and a housing opening from which extends an aperture to said outer edge wherein said base plate and cover plate are fitted within said housing opening and said bulb extends into said aperture.

21. A flashlight assembly comprising:

a housing having an outer edge and an interior recess with an aperture extending from said interior recess to said outer edge;

a bulb in communication with said aperture having two diverging leads that extend into said interior recess; and, a battery movable within said interior recess in contact with one of said leads when in a bulb-off position and in contact with both leads when in a bulb-on position.

22. The assembly of claim 21 wherein said housing has an upper surface with a switch opening; and, a carrier detachably connected to said battery having an actuation area accessible through said switch opening.

23. The assembly of claim 22 wherein said carrier includes a biasing means for moving said carrier and battery from said bulb-on position to said bulb-off position.

24. The assembly of claim 23 wherein said housing includes a detent surface and said biasing means comprises a resilient member engaged with said detent surface.

25. The assembly of claim 24 wherein said housing includes an auxiliary recess that incorporates said detent surface;

said auxiliary recess being axially offset from said interior recess; and, said resilient member comprising a pair of outwardly flared arcuate flex elements extending axially from said carrier and being constrained within said auxiliary recess.

26. The assembly of claim 21 wherein said housing includes releasable engagement means for implements including any one or combination of knife, can opener and bottle opener.

* * * * *